United States Patent [19]

Benz et al.

[11] Patent Number: 4,811,586

[45] Date of Patent: Mar. 14, 1989

[54] LEVELING MACHINE FOR STEEL SHEET AND STRIP

[75] Inventors: Willi Benz, Neuss; Walter Eltinger, Düsseldorf, both of Fed. Rep. of Germany

[73] Assignee: SMS Schloemann-Siemag Aktiengesellschaft, Fed. Rep. of Germany

[21] Appl. No.: 142,503

[22] Filed: Jan. 11, 1988

[30] Foreign Application Priority Data

Jan. 10, 1987 [DE] Fed. Rep. of Germany ..... 3700555

[51] Int. Cl.[4] ..... B21D 1/02

[52] U.S. Cl. ..... 72/165; 72/244

[58] Field of Search ..... 72/165, 164, 162, 244, 72/248, 238

[56] References Cited

U.S. PATENT DOCUMENTS 2,132,426 10/1938 Maussnest ..... 72/165

2,429,142 10/1947 Thomas ..... 72/164

2,949,147 8/1960 Maust ..... 72/164

3,301,031 1/1967 Bearer ..... 72/164

*Primary Examiner*—Daniel C. Crane

*Attorney, Agent, or Firm*—Toren, McGeady & Associates

[57] ABSTRACT

A leveling machine for steel sheet and strip includes changing cartridges between sets of leveler rolls including support rollers and adjustable crossheads. Each changing cartridge includes three cartridge portions which are connected to each other by means of two intermediate joints. The middle cartridge portion is supported on the corresponding crossheads by means of two spaced-apart rigid supports, so that only the outer cartridge portions can be limited in their pivoting positions by means of adjusting wedges or the like and, for compensating sagging of the crossheads, the leveler rolls must only be subjected to a prebending force in the regions away from the middle cartridge portion.

5 Claims, 2 Drawing Sheets

LEVELING MACHINE FOR STEEL SHEET AND STRIP

BACKGROUND OF THE INVENTION

1. Field of the Invention

The present invention relates to a leveling machine for steel sheet and strip, particularly for cold-rolled steel sheet and strip. The leveling machine includes upper and lower leveler rolls which are arranged offset relative to each other and are supported along their length by means of support rollers mounted in bearing blocks. The support rollers, in turn, are supported in crossheads, wherein at least the upper crosshead is adjustable for positioning the leveler rolls Changing cartridges are arranged between the crossheads and the leveler rolls for exchanging a set each of leveler rolls and support rolls. The changing cartridges are of an articulated construction, so that the support rollers can be preadjusted in groups on the two sides of the middle vertically extending transverse plane of the crossheads and leveler rolls. The preadjustment serves to compensate the sagging of the leveler rolls while taking into consideration the bending of the crossheads due to the leveling force, so that the leveler rolls are straight during leveling.

2. Description of the Prior Art

Leveling machines of the above-described type are known and provide so-called tilting yoke adjustment. Leveling machines of this type have upper and lower transverse yokes or crossheads and changing cartridges which are divided in the middle vertically extending transverse plane of the leveler rolls and are articulated by means of articulated joints in such a way that the portions of the crossheads and cartridges including the groups of support rollers for the leveler rolls supported by the cartridges are slightly tilted or adjusted in the shape of a V under idle running conditions. When the leveling force becomes effective, the crossheads and changing cartridges are supposed to bend until the preadjusted V-shape disappears and the groups of support rollers are in axial alignment and, thus, the leveler rolls are straight. As a result, the sagging of the crossheads is compensated.

Of course, the crossheads or at least the upper crosshead as a whole are obliquely adjustable in feeding direction of the material to be leveled by means of two pairs of adjusting devices supported in stands. Accordingly, the depth of immersion of the offset leveler rolls can be decreasingly adjusted from the entry side of the material to be leveled to the exit side in order to obtain an overstretching distribution.

The sagging behavior of divided crossheads of known steel sheet leveling machines with the above-described tilting yoke adjustment is determined by the fact that the crossheads are to be considered girders having two supports, wherein the bending forces act at least initially in the middle plane of symmetry until the leveler rolls are straight due to the bending or sagging of the crossheads. Thus, an optimum sagging is achieved at a predetermined bending stiffness of the crossheads. However, the extent of the preadjusted V-shape of the divided crossheads is also dependent upon the degree of sagging. Since, moreover, the leveler rolls should under idle running conditions already rest against the groups of support rollers which are also aligned in a V-shape, the leveler rolls must also be prebent into a V-shape by means of forces acting at the ends thereof. Since, due to the significant tilted position of the groups of support rollers to the left and right of the middle vertically extending transverse plane of the crossheads, the leveler rolls must be prebent to a significant degree, the leveler rolls are subjected to substantial bending forces until they become straight as a result of the leveling forces.

It is, therefore, the primary object of the present invention to improve the above-described known tilting yoke adjustment in a leveling machine for steel sheet and strip, so that the leveler rolls must be prebent to a lesser extent prior to the occurrence of the leveling force. Thus, the leveler rolls are to be subjected to a more careful treatment during operation.

SUMMARY OF THE INVENTION

In accordance with the present invention, in a leveling machine having single-piece crossheads, the changing cartridges include three cartridge portions which are connected to each other by means of two intermediate joints. The cartridge portions carry the bearing blocks of the groups of support rollers. The middle portion of the cartridge portions of each cartridge has in the region of its ends symmetrically relative to the middle transverse plane of the crossheads and leveler rolls two spaced-apart rigid supports by means of which the middle portion is supported on the crosshead. The two outer portions of the cartridge each have in the region of the outermost support rollers an adjusting device which serves to limit the pivoting position of the outer portion relative to the crosshead.

Accordingly, in the leveling machine according to the present invention, the crossheads are each constructed as a single piece in the conventional manner. However, the changing cartridges no longer are constructed in two portions Rather, each changing cartridge includes three portions with a middle portion and two outer portions connected to the middle portion by means of intermediate joints. The fact that the middle portion is supported on the crosshead by means of two spaced-apart rigid supports means that the bending behavior of the single-piece crosspiece is improved, so that the crosshead may be of a construction having a lower structural weight.

However, for a more careful treatment of the leveler rolls during operation it is more important that the preadjusted tilting adjustment of two groups of support rollers exists only in the region of the two outer portions of the non-rigid changing cartridge which outer portions are connected to each other in an articulated manner, wherein the pivoting position of each portion is limited in the direction of the leveling force relative to the corresponding crosshead by means of an adjusting device. As a result, prebending of the leveler rolls is no longer necessary in the middle portion thereof, but only at the ends, in order to ensure even during the idle running condition a contact between the ends of the leveler rolls and the outer groups of support rollers.

The adjusting devices act as limiting stops and advantageously are adjusting wedges extending transversely of the leveler rolls. Seen in feeding direction of the material to be leveled, the adjusting wedges extend in each adjusting position thereof over the length of the cartridge. The cartridges are each pressed against the rigid supports and the adjustment wedges by means of pretensioned tension members which are fixed to the corresponding crosshead. These pretensioned tension members serve to balance at least the upper cartridge because, prior to leveling under idle running conditions, not only the middle portion of the cartridge is pressed against the two rigid supports on the crosshead, but also the outer portions, in the upwardly directed pivoting position thereof, are pressed against the adjusting wedges.

Although, due to the weight of the lower cartridge, the middle portion of the lower cartridge would rest against the supports on the crosshead and the outer portions in the downwardly inclined pivoting position would rest against the adjusting ridges, it is recommended, for stabilizing the conditions in the lower cartridge, to provide pretensioned tension members fixed to the corresponding crosshead.

To ensure that even under idle running conditions, i.e., when the pairs of upper and lower outer portions of the cartridges including support rollers diverge, the leveler rolls rest also against the outer support rollers, so that impacts are avoided when the material to be leveled enters the roll arrangement, it is proposed in accordance with the present invention to apply to the bearing housings of the leveler rolls the double chock bending system which is known from rolling mill construction. In other words, the bearing housings are subjected to bending moments which bend the upper leveler rolls at their ends upwardly and the lower leveler rolls at their ends downwardly, i.e., against the backwardly offset outer support rollers which are supported by the diverging pairs of outer portions of the cartridges. The bending moments are produced by second pretensioned tension members which are located in the interior and are connected rigidly with respect to tension to the bearing housings, and by outer preloaded compression members, so that a pair of forces acts on each bearing housing in order to bend the leveler rolls at the ends thereof in the manner described above.

Since the bearing housings of the leveler rolls and the leveler rolls proper are fixed by the pretensioned second tension members to the outer portions of the cartridge because these second tension members are fixed with respect to tension to the bearing housings, the cartridge including the support rollers and the corresponding leveler rolls form a connected structural unit which can be axially removed for exchanging the leveler rolls. Thus, changing cartridges are provided which can be removed together with the corresponding leveler rolls. For this purpose, in accordance with a feature of the present invention, the fixed connections with respect to tension between the pretensioned tension members on the crosshead and the box-like cartridge can be separated, as shall be explained in more detail in the detailed description of the invention.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE DRAWING

Figure 1:
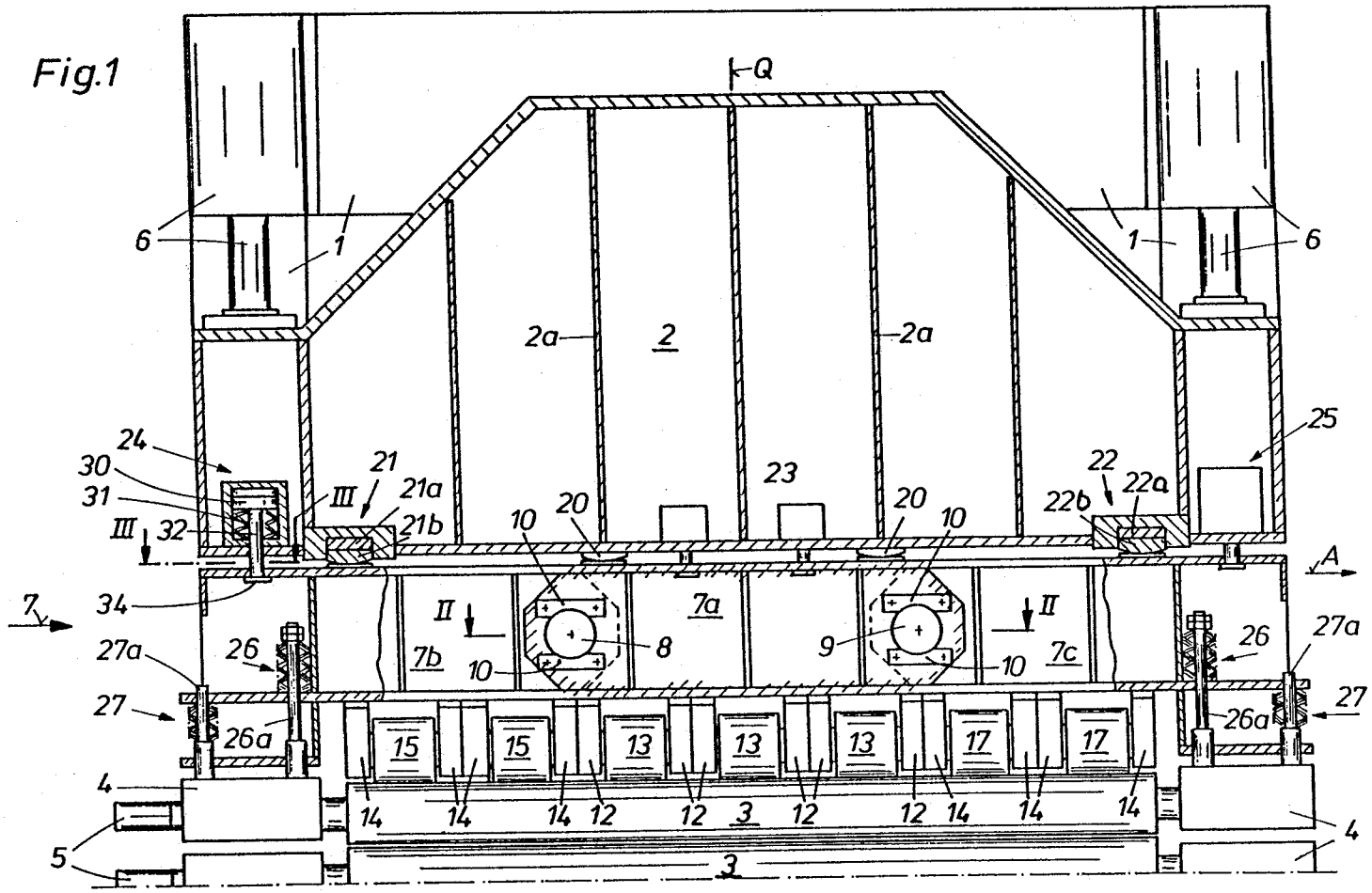
FIG. 1 is a partial front elevational view of a leveling machine according to the present invention, partially in section, transversely of the feeding direction of the material to be leveled.

The principal components of the leveling machine which is partially illustrated in FIG. 1 are two pairs of stand-like frames 1. In FIG. 1, only the frame on the exit side is illustrated, the feeding direction of the material to be leveled coinciding with the viewing direction when looking at FIG. 1 of the drawing. An upper and a lower crosshead 2 extend between the frames 2. The lower crosshead 2 is not shown. The crossheads 2 are stiff with respect to being. The crossheads 2 support leveler rolls 3 which are arranged offset relative to each other in feeding direction and which are mounted in bearing housings 4 in a manner not illustrated in detail, leveler rolls 3 are driven through journals 5 located on the lefthand side as seen in FIG. 1, so that the removal side for exchanging the rolls is located on the right as seen in FIG. 1 of the drawing.

The crossheads 2 can be moved upwardly and downwardly by means of four adjusting devices 6 in order to influence the relative position of the upper and lower leveler rolls 3 transversely of the feeding direction of the material to be leveled. For adjusting the overstretching distribution, the crossheads 2 and, thus, the leveler rolls 3 are adjusted in the known manner to provide a greater degree of overstretching on the inlet side than on the outlet side, i.e., the crossheads 2 are adjusted so as to diverge somewhat in feeding direction.

Due to the symmetry of the leveling procedure, it is recommended to provide also the lower crosshead 2, not shown, with four adjusting devices 6. However, this is not absolutely necessary.

Further details of the leveling machine illustrated in FIG. 1 are explained only with respect to the upper portion of the machine, however, these details also are applicable in the same manner to the identically constructed lower portion.

The novel concept according to the present invention lies in a non-rigid, box-like cartridge 7 between the crosshead 2 and the leveler roll 3. The cartridge 7 extends over the entire length and width of the crosshead 2. Cartridge 7 is composed of a middle portion **7*a* and two outer portions 7*b*, 7*c*. The middle portion 7*a* is shown with cross-hatching at the edges thereof. The outer portions 7*b* and 7*c* are connected in an articulated manner in the direction of the occurring leveling forces by means of intermediate joints 8 and 9**.

Figure 2:
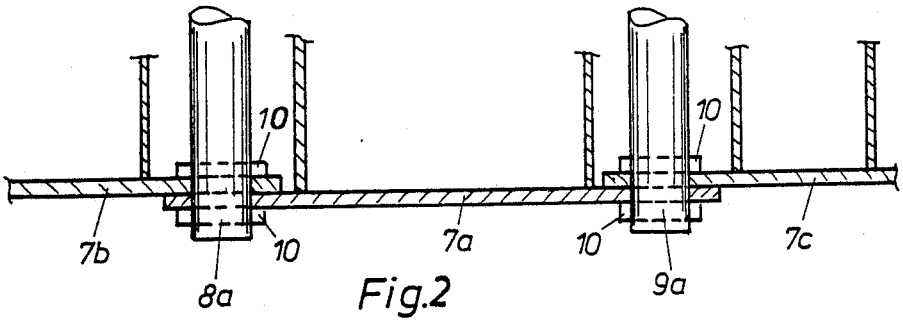
FIG. 2 is a partial horizontal sectional view taken along sectional line II—II in FIG. 1 illustrating the articulated joints of the changing cartridge of the leveling machine.

As can be seen in the partial horizontal cross-section of FIG. 2, joint bolts **8*a* and 9*a* extend horizontally and connect projecting and overlapping plate portions of the cartridge portions 7*a*, 7*b* and 7*c*. Joint bolts 8*a* and 9*a* are fixed by means of upper and lower locking bolts 10. The joint connections 8 and 9 illustrated in FIGS. 1 and 2 on the inlet side of the non-rigid cartridge 7 are also provided on the outlet side of the cartridge 7 because the joint bolts 8*a* and 9*a*** extend continuously to the end of the cartridge on the outlet side.

The middle portion **7*a* supports bearing blocks 12 for a group of support rollers 13 which support a leveler roll 3. Outer portion 7*b* supports bearing blocks 14 for two additional support rollers 15 for each leveler roll 3** and the outer portion *7a* supports bearing blocks 16 for two additional support rollers 17. Thus, the leveling machine includes three groups of support rollers 13, 15 and 17, wherein the outer groups 15 and 17 can be adjusted independently of the middle groups of support rollers 13 due to the articulated connection of the outer portions *7b* and *7c* to the middle portion *7a*.

In the embodiment illustrated in the drawing, all support rollers 13, 15 and 17 are arranged in the vertical axial plane of leveler rolls 3. As a result, it is necessary that the position of the bearing housings 4 of the leveler rolls are fixed in horizontal direction, for example, by resting against adjacent bearing housings 4. However, it is also possible and known in the art to support each leveler roll by means of a saddle-type arrangement of support rollers in the shape of a V, so that the leveler roll is fixed in horizontal direction.

The middle portion *7a* is supported in the region of its ends and symmetrically relative to the middle transverse plane Q of the rigid crosshead 2 and of the leveler roll 3 by means of two rigid supports 20 which are arranged spaced apart at a relatively great distance and which conduct the leveling force transmitted from the support rollers 13 in a relatively wide distribution over the crosshead 2, so that the bending or sagging of the crosshead is favorably influenced. Advantageously, rigid supports 20 are arranged at vertically extending stiffening webs *2a* of crosshead 2.

For each outer portion *7b* and *7c* of the non-rigid cartridge 7 is provided in the regions of the outer support rollers 15 and 17 an adjusting device 21 and 22, respectively, which limits the pivoting position of the outer portion relative to the crosshead 2. In the illustrated embodiment, the adjusting devices are adjusting wedges 21*a*, 22*a* which extend transversely of the leveler rolls 3. Seen in feeding direction of the material to be leveled, the adjusting wedges 21*a*, 22*a* extend in each adjusting position thereof over the length of the cartridge 7. Adjusting wedges 21*a*, 22*a* rest against fixed counter wedges 21*b*, 22*b* mounted on crosshead 2.

Cartridge 7 is being pressed against rigid supports 20 and adjusting wedges 21*a*, 22*a* by means of pretensioned first tension members 23, 24 and 25 which are secured to crosshead 2. For balancing reasons, these tension members are absolutely required for the upper cartridge 7, however, for stabilizing reasons, the tension members are also provided for the lower cartridge. The outer elastic tension members 24 and 25 are necessary for the lower cartridge for the reasons described below.

In FIG. 2, cartridge 7 is illustrated in the straight stretched position which cartridge 7 is intended to assume when the leveling force is acting, while taking into consideration the bending of the crosshead 2. Without this bending, i.e., under idle running conditions, the rigid supports 20 for the middle portion *7a* are adjusted slightly lower (slightly higher for the lower portion of the machine) by means of adjusting devices 6, so that the outer portions *7b* and *7c* rest against the adjusting wedges 21*a*, 22*a* while assuming a pivoted tilting position. This adjustment is effected by the elastic tension members 24 and 25.

Figure 4:
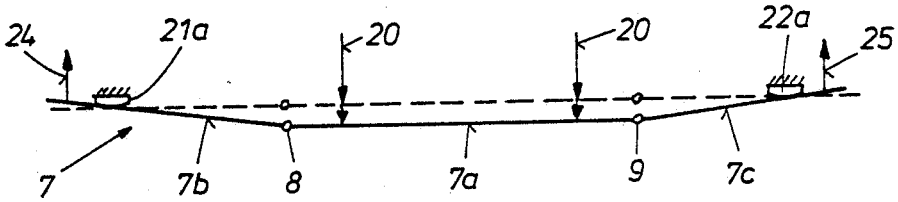
FIG. 4 is a schematical illustration of the three-part non-rigid cartridge prior to and during leveling.

FIG. 4 schematically shows in side lines the tilting position of the outer portion *7b* and *7c* relative to the middle portion *7a* under idle running conditions. The same representation, although mirror-inverted, is applicable to the lower portion of the machine. Advantageously, outer portions *7b* and *7c* of the lower cartridge are maintained pressed against the lower adjusting wedges 21*a*, 22*a* by downwardly directed tensional forces, so that the pairs of outer portions *7b* and *7c* which are located above one another are diverging by the same angle.

As mentioned above, the outer groups of support rollers 15 and 17 are supported by the pivotable outer portions *7b* and *7c*, respectively, so that these support rollers can also assume the tilted position illustrated in FIGS. 4. Under idle running conditions, these support rollers 15, 17 would not rest against the leveler rolls 3 and would not impact on the latter when the leveling force is applied. To ensure that any possible traces of such impacts are not transmitted to the material to be leveled, the double chock bending system is applied to the bearing housings 4 of the leveler rolls 3, in order to prebend the outer ends of the leveler rolls 3 in such a way that they rest against the support rollers 15 and 17 even during idle running, the support rollers 15 and 17 also assuming the tilted position relative to the middle support rollers 13. In order to adjust this prebending of the leveler rolls, the bearing housings 4 are pulled at their inner ends facing the leveler rolls 3 by means of pretensioned second tension members 26 in the direction of the outer portions *7b* and *7c* and are pressed at their outer ends by means of preloaded compression members 27, wherein the tension members 26 and the compression members 27 both rest against the outer portions *7b* and *7c* of cartridge 7. The tensioning and compression forces are generated by stacks of cup springs which act on tension rods 26*a* and compression rods 27*a*, respectively. The tension rods 26*a* are rigidly connected to the bearing housings 4 with respect to tension. Due to the oppositely directed pairs of forces from the tension members 26 and the compression members 27, moments act on the bearing housings 4 which bend the leveler rolls even under idle running conditions at their ends until they rest against the outer support rollers 15, 17 fixed at the outer portions of the cartridge 7.

Accordingly, it is ensured, as illustrated in FIG. 4 of the drawing, that the leveler rolls rest against the outer support rollers 15 and 17 even under idle running conditions in spite of the diverging positions of the outer support rollers 15 and 17. The advantageous operation of the non-rigid cartridge 7 is apparent from the tilted position illustrated in sidelines obtained by preadjustment of the rigid supports 20 by means of the adjusting devices 6 and the adjusted position of the adjusting wedges 21*a* and 22*a* change over to the stretched position of cartridge 7 due to the leveling force and by utilizing the intermediate joints 8 and 9. This straight position of cartridge 7 is also seen in FIG. 1. In this position, all groups of support rollers 15, 13, 17 are horizontally in alignment and the leveler rolls 3 are straight. The return bending of the prebent leveler rolls is slight and provides a careful treatment under operation because bending takes place only at the ends of the leveler rolls.

Figure 3:
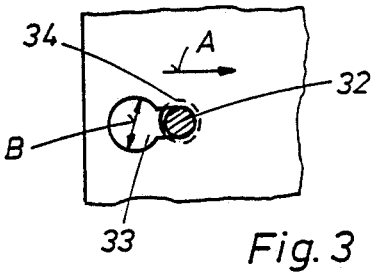
FIG. 3 is an illustration of a detail along sectional line III—III of FIG. 1.

In the embodiment illustrated in FIG. 1, the leveler rolls 3 can be removed for regrinding toward the right in FIG. 3 in the conventional manner by separating the connections between the tension rods 26*a* of the pretensioned member 26 and raising the compression rods 27*a* of the elastic compression members 27. However, the manual operations required for this purpose can be avoided if the entire cartridge 7 including support rollers and upper and lower rolls is constructed as a changing cartridge. As illustrated in detail with respect to retensioned tension member 24, the tension members 23, 24 and 5 are constructed as piston-cylinder units whose pistons 30 are spring-loaded in tensioning direction by means of cup springs 31 and a pressure medium can act thereon in the opposite direction.

As illustrated in FIG. 3, piston rods 32 extend through oblong holes 33 in the outer walls of the box-like cartridge portions and are provided at the free ends thereof with collars 34 for transmitting the tensioning force. Opposite the direction A for removing the cartridge, the oblong holes 33 are widened to a diameter B which is greater than the diameter of collar 34. In this removal position, crosshead 2 is raised or lowered by means of adjusting devices 6, so that the upper or lower cartridge 7 can be removed together with all parts connected thereto.

While a specific embodiment of the invention has been shown and described in detail to illustrate the application of the inventive principles, it will be understood that the invention may be embodied otherwise without departing from such principles.

We claim:

1. In a leveling machine for steel sheet and strip, including upper and lower horizontally extending leveler rolls arranged offset relative to each other and supported along their length by means of support rollers mounted in bearing blocks, the support rollers being supported in crossheads, wherein at least the upper crosshead is adjustable for positioning the leveler rolls, changing cartridges being arranged between the crossheads and the leveler rolls for exchanging a set each of leveler rolls and support rolls, the changing cartridges being of an articulated construction for a tilting yoke adjustment, whereby portions of the changing cartridges and associated groups of support rollers can be preadjusted on the two sides of the middle vertically extending transverse the plane of the crossheads and leveler rolls to a fitted position by means of first tension members which are fixed to the corresponding crosshead, the tilting movements being effected about axes which extend perpendicularly of the leveler rolls, the preadjustment serving to compensate the sagging of the leveler rolls while taking into consideration the bending of the crossheads due to the leveling force, so that the leveler rolls are straight during leveling, the improvement comprising the crossheads being single-piece crossheads, the changing cartridges being divided perpendicularly of the leveler rolls into a middle cartridge portion having two ends and two outer cartridge portions connected to the middle portion by means of two intermediate joints at the ends of the middle cartridge portion, each of the cartridge portions carrying the bearing blocks of the groups of support rollers, the middle cartridge portion of each cartridge being supported in the region of its ends on the corresponding crosshead by two spaced-apart rigid supports arranged symmetrically relative to the middle vertically extending transverse plane of the crossheads and leveler rolls, the pivoting positions of the two outer cartridge portions relative to the corresponding crosshead being limited by adjustable stops attached to the crosshead, whereby the preadjusting forces during tilting yoke adjustment and the structural weight of the crosshead are minimized.

2. The leveling machine according to claim 1, wherein the steel sheet and strip is cold-rolled.

3. The leveling machine according to claim 1, wherein the adjusting stops are adjusting wedges extending transversely of the leveler rolls, the steel sheet and strip being moved through the leveling machine in a feeding direction, the adjusting wedges extending in each adjusting position thereof over the length of the cartridge in feeding direction.

4. The leveling machine according to claim 3, wherein the leveler rolls are mounted in bearing housings having inner ends facing the leveling rolls, the bearing housings being pulled at their inner ends toward the outer cartridge portions by means of pretensioned second tension members fixed to the outer cartridge portions, wherein the bearing housings have outer ends, preloaded compression members acting on the outer ends, the compression members being supported by the outer cartridge portions and providing a compressive force acting on the bearing housings resulting in moments which prebend the leveler rolls even under idle running conditions at the ends thereof until they rest against the outer support rollers fixed to the outer cartridge portions.

5. The leveler machine according to claim 4, wherein the pretensioned first tension members are piston-cylinder units, wherein the pistons are spring-loaded in tension direction and a pressure medium can be applied in a direction opposite the tensioning direction, wherein the cartridge portions are box-like having outer walls, the piston-cylinder units having piston rods with free ends, the outer walls defining oblong holes, the piston rods extending through the oblong holes and provided with collars for transmitting the tensioning force, and wherein all oblong holes have on the sides thereof directed against a direction of removal of the cartridge a widened diameter portion, the direction of removal extending parallel to the axes of the leveler rolls, wherein the widened diameter is greater than the diameter of the collars of the piston rods.

* * * * *